United States Patent [19]

Roeser

[11] 3,990,578

[45] Nov. 9, 1976

[54] FOLDABLE DISPLAY PACKAGE

[75] Inventor: Stephen Roeser, Dumont, N.J.

[73] Assignee: Packaging Corporation of America, Evanston, Ill.

[22] Filed: Oct. 25, 1974

[21] Appl. No.: 517,868

[52] U.S. Cl. ..... 206/461; 206/45.14; 206/45.31; 206/333; 206/491; 248/174

[51] Int. Cl.[2] ..... B65D 75/62

[58] Field of Search ..... 220/4 E; 248/152, 174, 248/459; 206/45.14, 333, 334, 45.31, 461, 462, 485, 491

[56] References Cited

UNITED STATES PATENTS

| | | | |
|---|---|---|---|
| 2,326,648 | 8/1943 | Horr | 248/174 |
| 2,984,401 | 5/1961 | Herkender | 206/361 |
| 3,155,232 | 11/1964 | Leone | 206/45.14 |
| 3,184,046 | 5/1965 | Berg | 206/45.14 |
| 3,424,306 | 1/1969 | Munck | 206/333 |
| 3,486,615 | 12/1969 | Woskin | 206/491 |
| 3,487,915 | 1/1970 | Scott | 206/491 |
| 3,541,599 | 11/1970 | Ramshaw et al. | 206/45.14 |
| 3,635,331 | 1/1972 | Zucker | 220/4 E |
| 3,776,375 | 12/1973 | Rohdin | 220/4 E |

*Primary Examiner*—William T. Dixson, Jr.
*Assistant Examiner*—Bruce H. Bernstein
*Attorney, Agent, or Firm*—Neuman, Williams, Anderson & Olson

[57] ABSTRACT

A display package for a plurality of articles of like configuration (i.e., flashlight batteries) is provided which is formed from a single blank of foldable sheet material, such as paperboard. The package includes a partition, a sling-like member outwardly protruding from said partition and forming an open-sided pocket in which the articles are disposed. Article-retaining means are foldably connected to the partition and secured thereto in a pocket-closing position. The articles, when disposed within the pocket, are arranged in substantially parallel side-by-side relation.

7 Claims, 18 Drawing Figures

FIG. 5
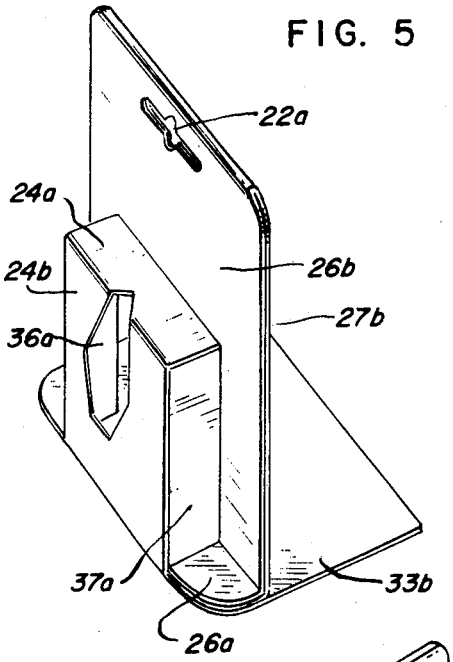
FIG. 2
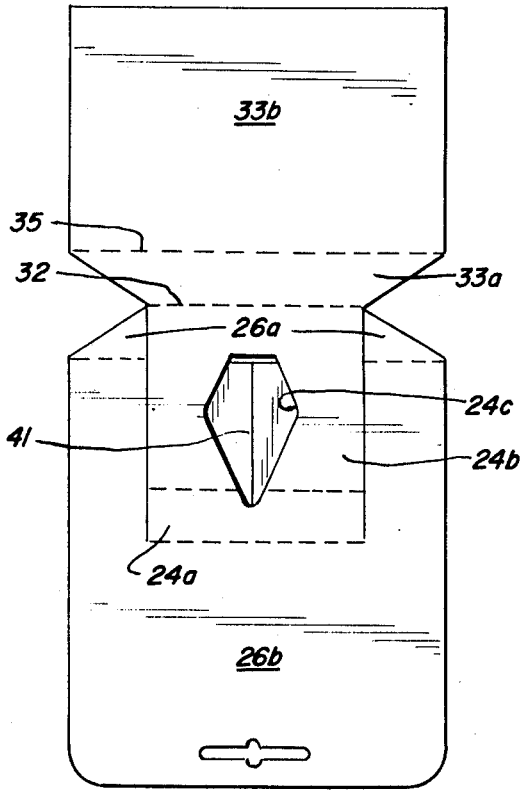
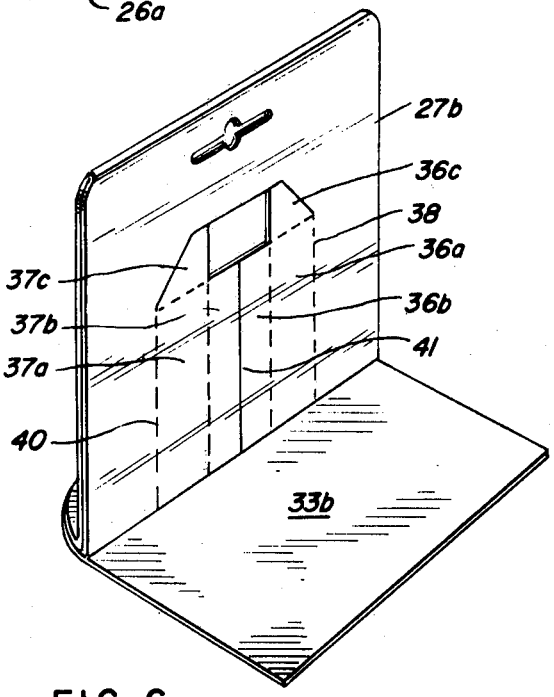
FIG. 6
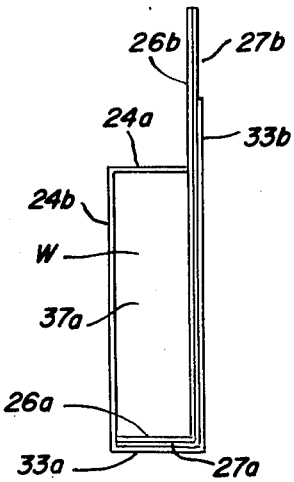
FIG. 11

FIG. 7
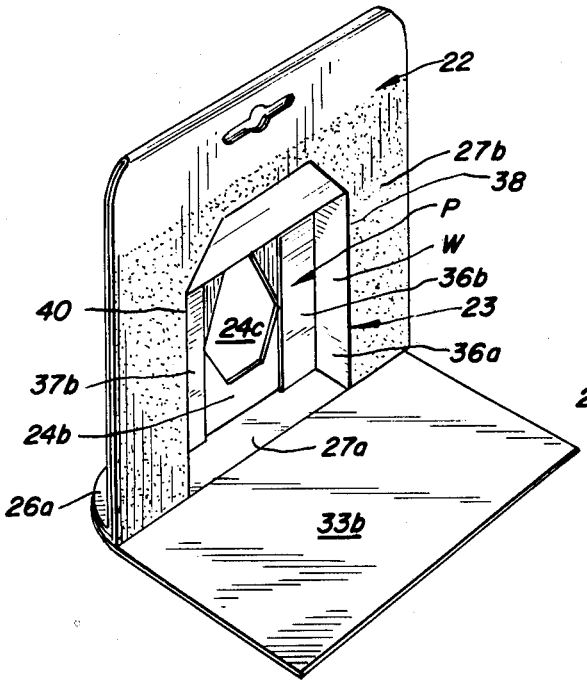
FIG. 8
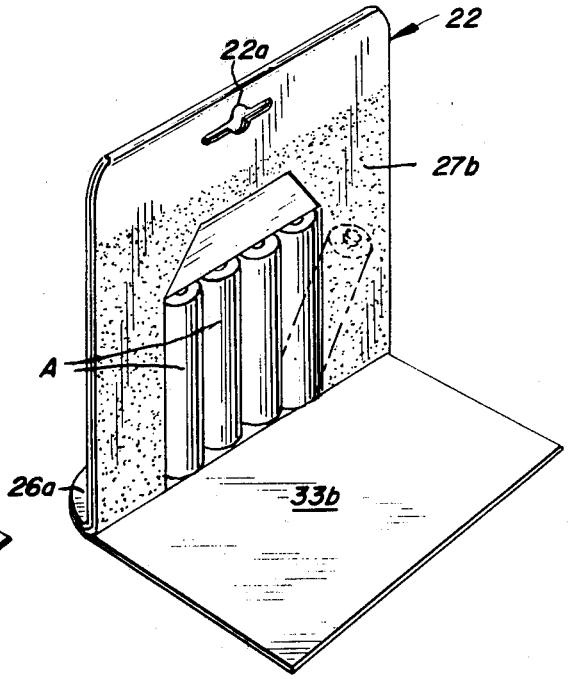
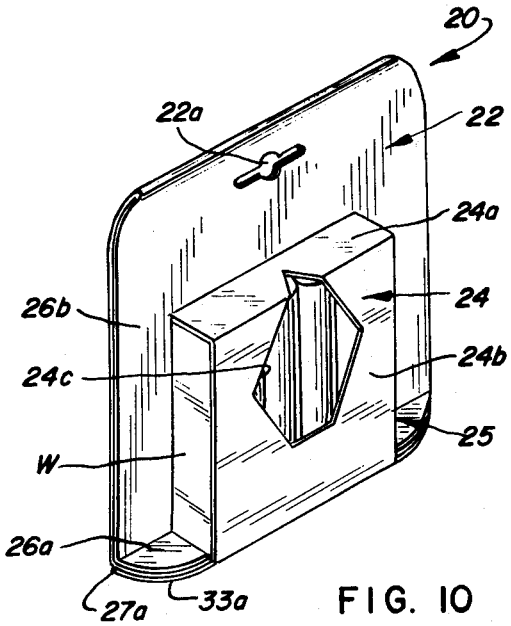
FIG. 10
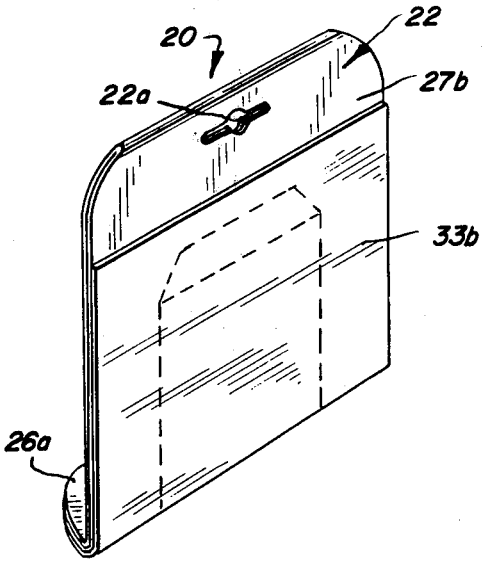
FIG. 9

FIG. 15
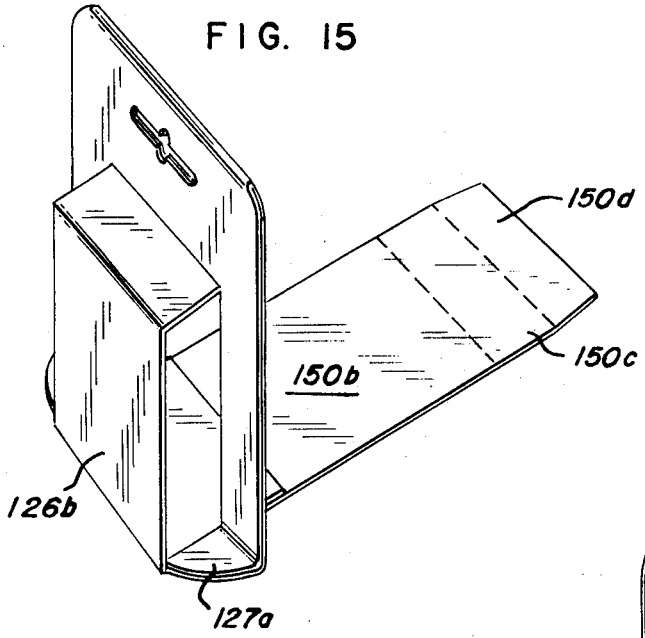
FIG. 17
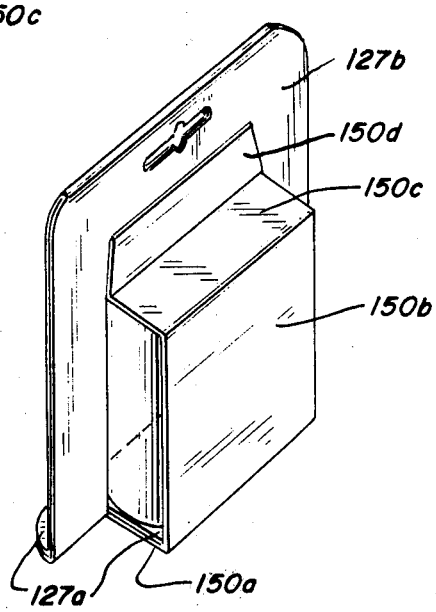
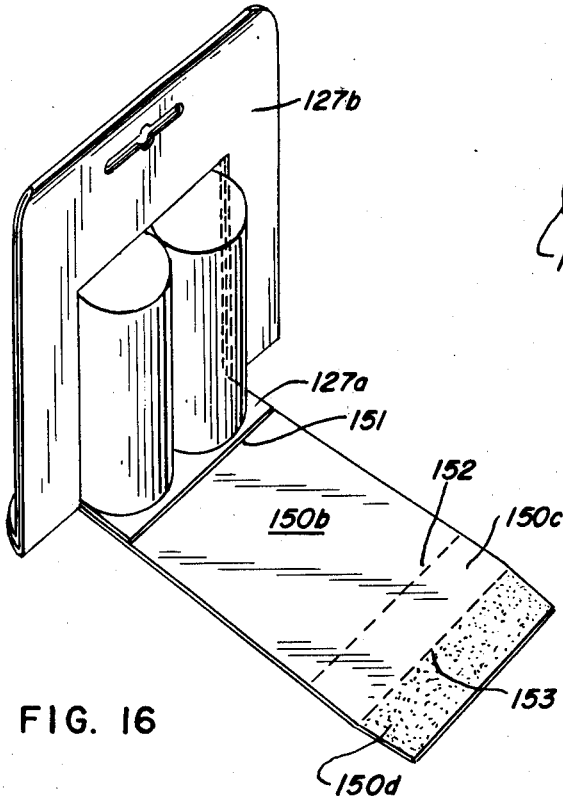
FIG. 16
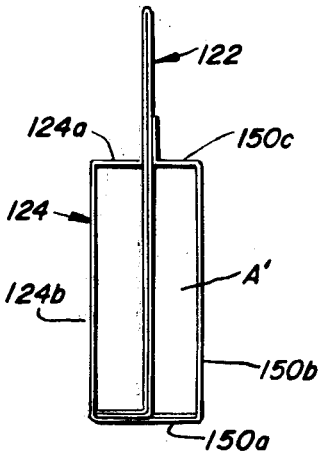
FIG. 18

FOLDABLE DISPLAY PACKAGE

BACKGROUND OF THE INVENTION

Various display packages have heretofore been provided; however, because of certain design characteristics they have been possessed of one or more of the following shortcomings: (a) the package is of fragile construction and incapable of withstanding repeated handling and, thus, provides minimal protection for the accommodated articles; (b) the package is of complex and costly construction and is difficult to load either manually or by automatic machinery; (c) the package is unattractive and incapable of being either self-supporting or suspended from a hook or rod; (d) the package is incapable of accommodating articles varying in size and shape; and (e) the accommodated articles are incapable of being observed by the customer while disposed within the package and thus the articles must be removed from the package in order to be seen or else the package must be mutilated in order to expose the article.

SUMMARY OF THE INVENTION

Thus, it is an object of the invention to provide a foldable display package which is not beset with any of the aforenoted shortcomings.

It is a still further object of the invention to provide a foldable display package which includes a carrier formed from a single blank of foldable sheet material capable of being die-cut and set up by high-speed automatic machinery of conventional design.

Further and additional objects will appear from the description, accompanying drawings, and appended claims.

In accordance with one embodiment of the invention, a foldable display package is provided which includes a carrier formed from a single blank of foldable sheet material and provided with a pocket accommodating a plurality of articles. The carrier comprises a first panel having a pocket-forming opening formed therein. Protruding outwardly from one surface of the first panel is a sling-like member. The sling-like member has one end thereof foldably connected to an upper peripheral segment of the pocket-forming opening in said first panel. The opposite end of the sling-like member is foldably connected to a base-forming second panel which subtends and is foldably connected to the lower edge of the first panel and projects angularly therefrom. A third panel is foldably connected to the second panel and is secured in a fold-back relation with respect to the opposite surface of the first panel. A portion of the third panel overlies the pocket-forming opening of said first panel and is adapted to retain the articles within the pocket.

DESCRIPTION

For a more complete understanding of the invention, reference should be made to the drawings wherein:

FIGS. 2 and 3 are similar views but of opposite sides of the blank of FIG. 1 subsequent to the completion of the initial folding step in setting up the carrier.

FIGS. 5 and 6 are similar perspective views taken from opposite sides of the blank subsequent to completion of the third folding step.

FIG. 7 is similar to FIG. 6 but showing the carrier pocket being formed for receiving the articles of the package.

FIG. 8 is like FIG. 7 but showing the carrier pocket filled with articles and prior to the pocket being closed. One article in phantom lines illustrates how an article is loaded into the pocket.

FIGS. 9 and 10 are similar perspective views taken from opposite sides showing the one form of the improved display package.

FIG. 11 is a right side elevational view of the package of FIG. 10.

FIG. 15 is similar to FIG. 5 but showing the blank of FIG. 12 subsequent to the completion of the second and third folding steps.

FIG. 16 is similar to FIG. 8, but showing articles of a different size being loaded into the carrier pocket.

FIG. 17 is similar to FIG. 9, but showing the blank of FIG. 12 fully set up as a second form of the improved display package.

FIG. 18 is a side elevational view of the package of FIG. 17.

Figure 3:
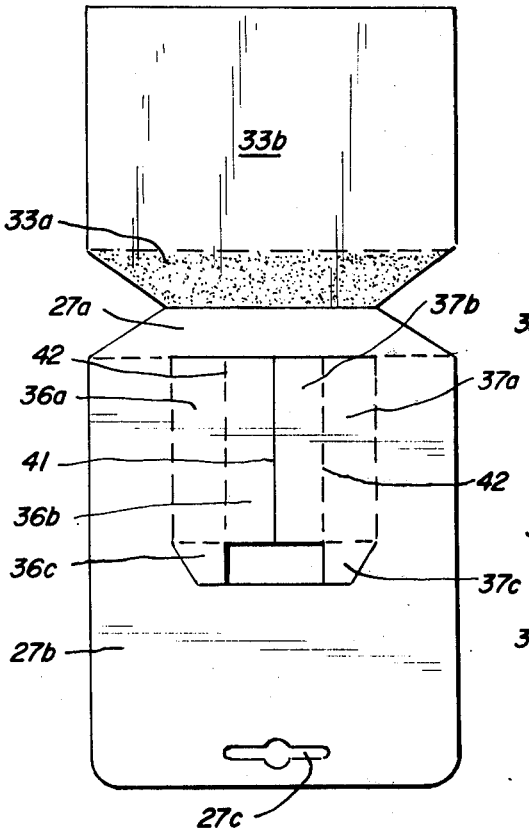
Figure 1:
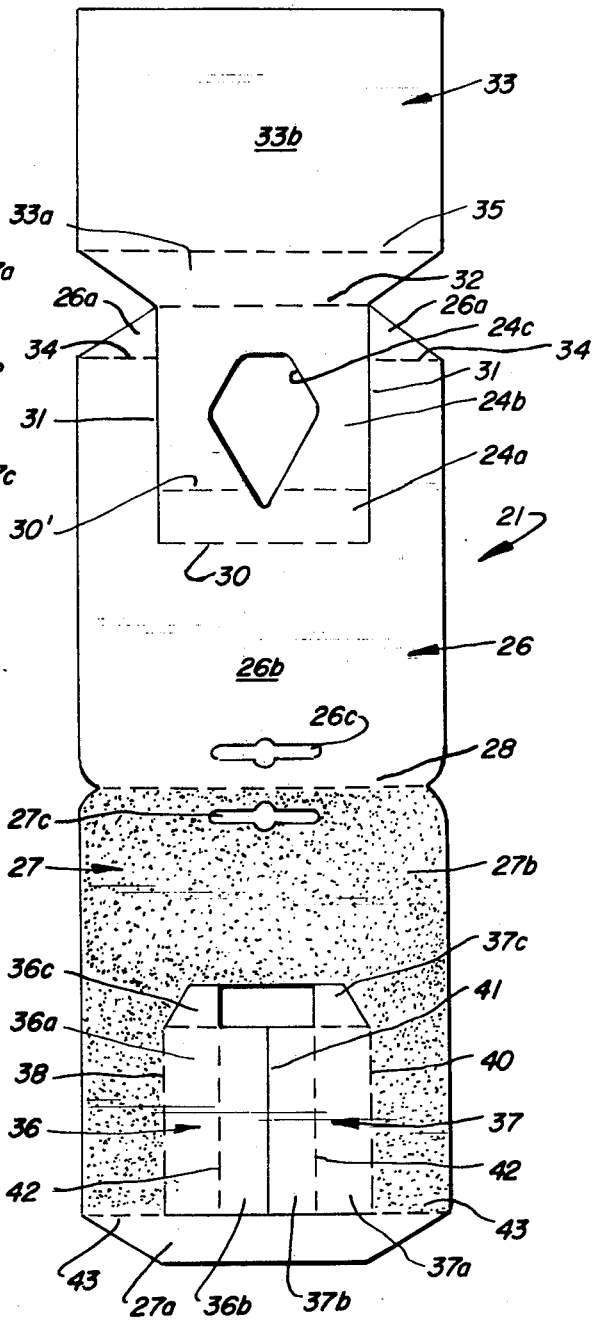
FIG. 1 is a plan view of a carrier blank utilized in the formation of one form of the improved display package.

Referring now to the drawings and more particularly to FIGS. 9 and 10, one form of the foldable display package 20 is shown which is adapted to be formed from a single blank 21 of foldable sheet material (i.e., paperboard) see FIG. 1. Package 20 in the illustrated embodiment is adapted to accommodate a plurality (i.e., four in number) of articles, such as size AA dry cell batteries, see FIG. 8.

Package 20 includes a carrier having an upright partition 22 provided with a pocket-forming opening 23. A sling-like member 24 protrudes transversely outwardly from one surface of the partition 22, see FIGS. 7 and 10. An upper section **24*a* of member 24 is connected by a foldline 30 to an upper peripheral segment of opening 23 and a front section 24*b* of the member is connected by a foldline 30' to section 24*a*. The bottom edge of front section 24*b* of the sling-like member 24 is connected by a foldline 32 to a transversely extending base 25. The base subtends the partition 22 and provides a means for making the package self-standing when placed on a shelf or countertop. To facilitate suspending or hanging the package from a hook or the like, a suitable slot 22*a* is provided in the upper portion of the partition 22** at substantially the center thereof.

The front section **24*b* and a portion of the upper section 24*a* of the sling-like member are preferably provided with an aperture 24*c*** which enables a customer to observe the contents of the package without the package being opened and/or mutilated.

Blank 21, as seen in FIG. 1, includes first and second panels 26 and 27 which are connected to one another by a foldline 28. Panels 26 and 27 are foldable about foldline 28 and adhesively secured in face-to-face relation so as to form partition 22. The sling-like member 24 is struck out from panel 26. The foldline 30 which connects upper section **24*a* to panel 26 also defines a peripheral segment of the opening 23. A pair of parallel cuts 31 extend from opposite ends of foldline 30 and terminate at second foldline 32, which connects panel 26 to a pocket-closing panel 33. Panel 33 will be described more fully hereinafter. Intermediate foldlines 28 and 32, panel 26 is provided with a foldline 34 which is interrupted by the front section 24***b* of sling-like member 24. Foldline 34 forms panel 26 into portions 26*a* and 26*b*. The portion 26*a* has like segments theereof disposed on opposite sides of member 24 and said segments are adapted to cooperate with other portions of the blank, to be hereinafter identified, to form the base 25.

Panel 33 is provided with a foldline 35 which is disposed in spaced parallel relation with respect to foldine 32. The spacing of foldlines 34 and 35 relative to foldline 32 is substantially the same. The portion 33*a* of panel 33, disposed between foldlines 32 and 35, is adapted to cooperate with panel portions 26*a* to form base 25 of the package in a manner to be hereinafter described.

Panel 27, which is connected by foldline 28 to the opposite edge of panel 26 from that of panel 33, is provided with a pair of foldable flaps 36 and 37 which are adapted to be folded about respective foldlines 38 and 40 so as to provide side walls W for the pocket P formed in the carrier to accommodate the articles, see FIGS. 7 and 8. As seen in FIG. 1 each flap 36 or 37 is of like construction and is separated from one another by a central cut 41 which is disposed equidistant from foldlines 38 and 40 and is substantially parallel thereto. Intermediate the cut 41 and the foldline 38 or 40 is a foldline 42 which forms each flap into a pair of elongated sections 36*a* and *b* and 37*a* and *b*. Flap sections 36*a* and 37*a* constitute the walls W of the pocket. When the pocket P is formed, flap sections 36*a* and 37*a* protrude transversely in one direction from panel 27 causing flap sections 36*b* and 37*b* to frictionally engage the concealed surface of the front section 24*b* of the sling-like member 24, see FIG. 7. Foldably connected to the upper edge of each flap section 36*a* or 37*a* is a tab 36*c* or 37*c*. When the flaps 36 and 37 are folded so as to form the pocket walls W, tabs 36*c* and 37*c* will frictionally engage the concealed surface of the upper section 24*a* of the sling-like member 24.

The foldlines 38, 40 and 42 and cut 41 are disposed in parallel relation and are positioned transversely of foldline 28. Panel 27 is also provided with a foldline 43 which is disposed in spaced, parallel relation with respect to foldline 28. Foldline 43 is aligned with and interrupted by the lower edges of the flaps 36 and 37. The foldline 43 forms panel 27 into portions 27*a* and 27*b* as seen more clearly in FIG. 1. Portion 27*b* may be provided with an adhesive coating which will cause the portion to be bonded to panel portion 26*b* upon the initial folding step about foldline 28 being completed, see FIG. 2. Panel portions 26*b* and 27*b* cooperate with one another to form the partition 22. Each panel portion 26*b* and 27*b* is provided with a slot section 26*c* and 27*c* which coact to form the slot 22*a* as seen in FIG. 10.

Figure 4:
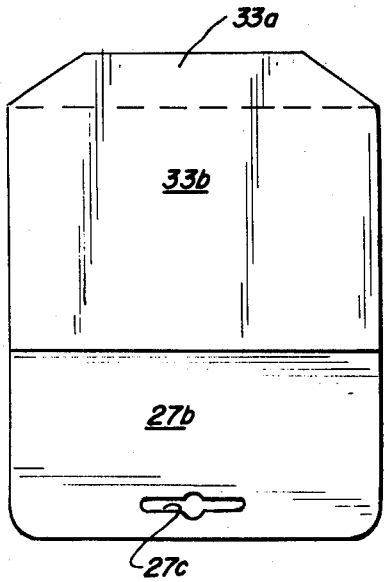
FIG. 4 is similar to FIG. 3 but showing the blank subsequent to completion of the second folding step in setting up the carrier.

When the second folding step (FIG. 4) of the blank has been completed, panel portion 27*a* will be sandwiched between panel portions 33*a* and 26*a* to form the base 25, see FIGS. 7, and 9–11. Portions 27*a* and 33*a* are adhesively secured together whereupon the panel portion 33*b* is moved to a horizontal position, as seen in FIGS. 5 and 6, causing the base-forming portions 26*a*, 27*a* and 33*a* to assume a right angle (horizontal) position relative to the upright partition 22. As the base-forming portions move to the horizontal position, the sling-like member 24 will automatically assume a protruding pocket-forming position as seen in FIG. 5.

Once the blank has assumed the position shown in FIG. 6, the flaps 36 and 37 are either manually or mechanically folded outwardly so as to form the pocket P as seen in FIG. 7, enabling the articles A to be loaded into the pocket, see FIG. 8. Once the pocket is loaded, panel portion 33*b* is folded to an upright position and adhesively secured to the panel portion 27*b*, see FIGS. 9 and 10. When panel portion 33*b* is secured in its upright position, the pocket P is effectively closed.

For purposes of illustration, the articles A in FIG. 8 are four (size AA) batteries. It is to be understood, of course, that the shape, size and number of articles accommodated in the pocket P may be varied without departing from the scope of the invention.

FIGS. 17 and 18 show a second form of the improved display package 120 which provides for the accommodated articles A′ to protrude outwardly from opposite sides of the upright partition 122. Where possible, parts of package 120 which correspond to like parts of package 20 will be designated by the same number except in the one-hundred series.

Package 120 includes a carrier formed from a single blank 121 of paperboard or the like. Two panels 126 and 127 are connected to one another by a foldline 128. Panel 126 has portions 126*a* and *b* which are similar in configuration and size to portions 26*a* and *b* of blank 21. Similarly, sling-like members 24 and 124 are of like configuration except no aperture is provided in member 124.

In lieu of the pocket-closing panel 33 of blank 21, a second sling-like member 150 is provided. Member 150 is connected by foldline 132 to the front section 124*b* of member 124. Member 150 is provided with a plurality of spaced parallel foldlines 151, 152 and 153, all of which are parallel to foldline 132. By reason of the foldlines, member 150 is formed into sections 150*a*, 150*b*, 150*c* and 150*d*. Section 150*a* is adapted to project transversely from the partition and subtend the articles A′ when the package is formed. Section 150*b* extends upwardly from section 150*a* and overlies one side of the accommodated articles, as seen more clearly in FIGS. 17 and 18. The articles A′ are snugly sandwiched between sections 124*b* and 150*b* in the formed package. Section 150*c* partially overlies the tops of the accommodated articles and is in substantial coplanar relation with section 124*a* of the member 124. Preferably, section 150*d* is adhesively secured to the exposed surface of panel 127, as seen in FIG. 17; however, in certain instances section 150*d* may be inserted between section 124*a* and the articles A′ and be secured to the concealed surface of section 124*a*. The two sling-like members 124 and 150 cooperate with one another to form a suitable pocket for the articles.

As seen in FIG. 18, partition 122 prevents sidewise movement of the accommodated articles and yet portions of the articles may be readily observed by the customer from opposite sides of the package without necessitating removal thereof from the package.

Figure 12:
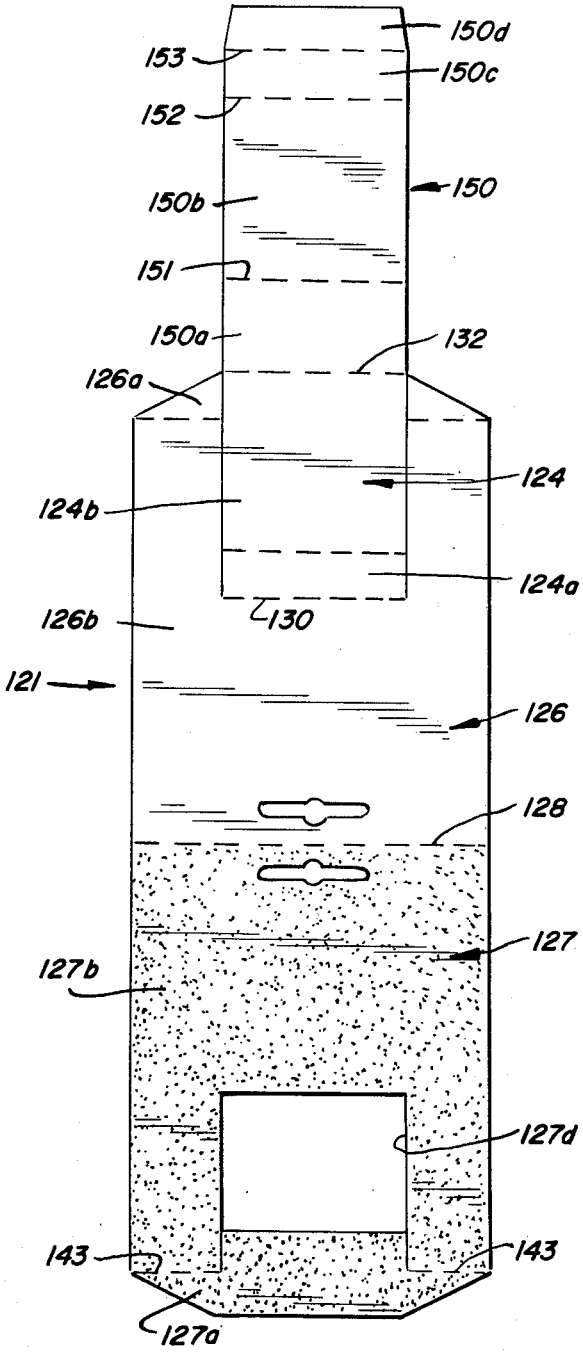
FIG. 12 is a plan view, similar to FIG. 1, but of a second form of carrier blank.

As seen in FIG. 12, panel 127 is provided with a foldline 143 which is disposed in spaced parallel relation with respect to foldline 128. The foldline 143 is interrupted by an openning 127*d* which is formed in panel 127. The width and length dimensions of the opening 127*d* will depend upon the shape and number of articles to be contained within the package.

Foldline 143 forms panel 127 into sections 127*a* and 127*b* with section 127*a* being secured in face-to-face relation with section 126*a* to form the upright partition 122. Section 127*a* is provided with a protruding peripheral portion which extends into opening 127*d* when the blank 121 is in its unfolded state, see FIG. 12.

Figure 13:
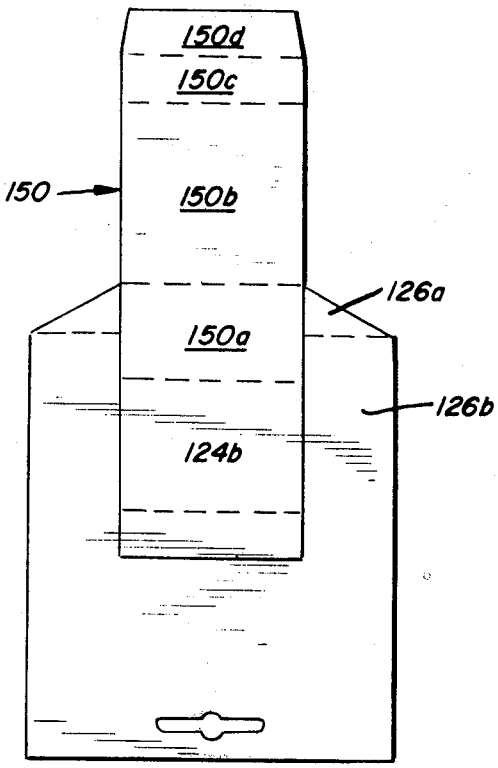
FIGS. 13 and 14 are similar to FIGS. 2 and 3, respectively, but showing the blank of FIG. 12 subsequent to the completion of the initial folding step.

In setting up the blank 121 to form the package 120, the sling-like member is initially folded about foldline 130 as an axis so that section 124*a* is sandwiched between section 124*b* and panel section 126*b*, see FIG. 13. Simultaneous with the initial folding of member 124, panel 127 is folded about foldline 128 and the rrespective panel sections 127*a* and 127*b* are adhesively secured to section 150*a* of member 150 and panel sections 126*a*, and to panel section 126*b*, as seen in FIG. 14.

Figure 14:
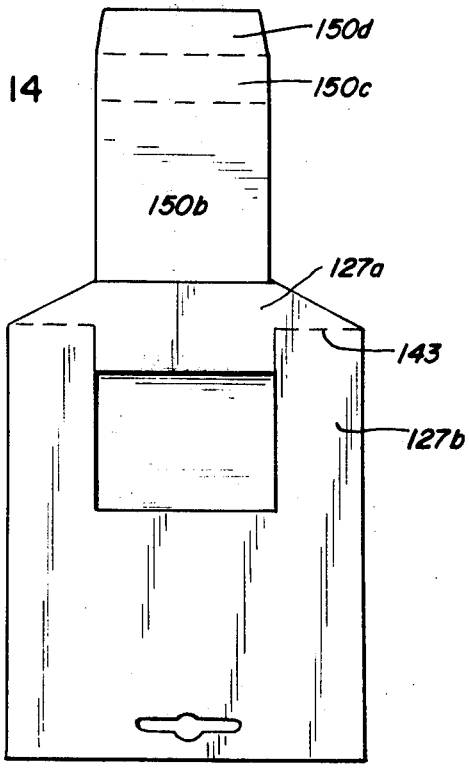

Once the blank 121 has assumed the partially set-up condition shown in FIGS. 13 and 14, the sling-like member 150 is folded relative to the partition 122 so as to assume a horizontal position as seen in FIGS. 15 and 16. Because of the adherence of section 127*a* to section 150*a*, folding member 150 to a horizontal position will automatically cause sling-like member 124 to assume its extended position as seen in FIG. 15, whereby the articles A′ may be readily insrted into the partial pocket formed by the extended member 124, see FIG. 16. Once the articles have been positioned within the partial pocket, sling-like member 150 is folded to an upright postion about foldline 151, whereupon section 150*b* will overlie a portion of the exterior of the articles. upon section 150*b* assuming its upright position, section 150*c* is folded towards partition 122 about foldline 152 and then section 150*d* is folded upwardly about foldline 153 and adhesively secured to the exposed surface of panel section 127*b*.

In place of securing the section 150*d* to panel section 127*b*, as seen in FIGS. 17 and 18, section 150*d* may be inserted between the upper end portions of the articles and section 124*a* of member 124 and be secured to the concealed surface of the latter.

In blank 21, member 24 and panel 33 may be construed as inner and outer portions, and in a like manner, members 124 and 150 may be similarly construed.

As aforenoted, the configuration of the pocket formed in both of the illustrated embodiments may be readily varied and will depend upon the size, shape and number of articles to be packaged. Thus, it will be seen that an improved display package has been provided which is of simple design, is formed from a single blank of foldable sheet material, is capable of being set up and loaded utilizing conventional high-speed automatic equipment, and is adapted to accommodate a variety of individual articles. The improved package is capable of being self-standing or being suspended from a hook or rod. When utilizing the improved package, the accommodated articles may be readily observed by a customer without the necessity of being removed from the package.

I claim:

1. A tamper-proof foldable display package comprising at least one article and a carrier therefor whereby the article is observable while disposed within the carrier and is removable therefrom only upon said carrier being mutilated; said carrier being formed from a single sheet of foldable material and including foldably connected first and second panels in contacting face-to-face relation and forming an upright partition and an angularly extending base disposed at the bottom of the partition, an elongated sling-like member foldably connected at one end to the partition and at the opposite end to the base, said sling-like member having a width less than the width of said partition and being struckout in one direction from the partition and cooperating with said panels to form a pocket accommodating the article therein whereby no portion of the article protrudes outwardly from the partition a greater distance than that of a portion of said carrier forming said pocket, and means associated with said partition for permanently retaining the article within the pocket; portions of said first and second panels disposed on opposite sides of said sling-like member being permanently secured to one another in face-to-face relation.

2. The foldable display package of claim 1 wherein the one end of said sling-like member is foldably connected to said first panel, and said second panel is provided with a pair of independent flaps connected thereto by spaced foldlines, the spacing between the flap foldlines being substantially equal to the width of the sling-like member one end, said flaps protruding from the partition into the pocket formed by said sling-like member and providing side walls therefor, the foldlines for said flaps at least partially delimiting an open side of said pocket.

3. The foldable display package of claim 2 wherein the foldline connections of said flaps are in substantially parallel relation and are disposed in transverse relation with respect to the folding connection between the one end of said sling-like member and the first partition-forming panel.

4. The tamper-proof foldable display package of claim 1 wherein the means aassociated with said partition for permanently retaining the article within the pocket includes a second sling-like member foldably connected to the base and extending in a second direction from the partition and cooperating with the first mentioned sling-like member and said partition to form the article-accommodating pocket, said second sling-like member having a first segment foldably connected to the base and subtending the accommodated article, a second segment foldably connected to the first segment and extending upright therefrom and overlying an exterior portion of the accommodated article, and a third segment foldably connected to the upper end of the second segment and extending angularly therefrom and overlying a second exterior portion of the accommodated article, said third segment being fixedly secured to said partition.

5. A foldable display package comprising at least one article and a carrier therefor formed of foldable sheet material; said carrier including first and second panels secured in face-to-face relation and forming an upright partition, an elongated sling-like member foldably connected at one end to one of the panels and protruding in one direction from one surface of the partition so as to form a pocket in which the article is disposed, the opposite end of said sling-like member being foldably connected to a base subtending and connected to said partition, said sling-like member having a pocket-forming section disposed in an upright position spaced from the partition one surface, and a third panel having a lower edge foldably connected to said base and extending upwardly therefrom and being secured in face-to-face relation with a second surface of the partition; said third panel having a portion thereof at least partially overlying an opening for the pocket.

6. A blank of foldable sheet material for a carrier wherein the latter is adapted to be used in combination with an article to form a display package wherein no portion of the article protrudes outwardly beyond the periphery of the carrier, said blank comprising a pair of first and second panels connected by a first foldline and being foldable relative to one another and secured in face-to-face relation and forming an upright substantially planar multi-ply partition, an elongated sling-like member having a first section connected by a second foldline to a medial portion of said first panel, said sling-like member having a second section connected by a third foldline to said first section and protruding beyond a peripheral segment of said first panel, said peripheral segment being opposite the first foldline connection between said first and second panels, said first and second sections having opposite sides thereof defined by a pair of spaced cuts formed in said first panel and extending transversely of said second and third foldlines, said first and second sections being foldable relative to one another and to said partition to form an article-accommodating pocket when said blank is set up to form the carrier, a first base-forming portion connected by a fourth foldline to said peripheral segment of said first panel, said fourth foldline being interrupted by the second section of said sling-like member, a second base-forming portion connected by a fifth foldline to the second section of said sling-like member and disposed opposite the first section thereof, a pocket-closing panel connected by a sixth foldline to said second base-forming portion and disposed opposite the second section of said sling-like member, and a third base-forming portion connected by a seventh foldline to a peripheral segment of said second panel disposed opposite the first foldline connection between said first and second panels, a medial portion of said second panel being provided with an opening aligned with the article-accommodating pocket when the blank is set up to form the carrier, the fourth and seventh foldlines being disposed on opposite sides of said first foldline and substantially equi-distant therefrom.

7. The blank of claim 6 wherein the opening formed in the medial portion of the second panel is delimited by a second pair of spaced cuts and a pair of spaced eighth foldlines extending angularly between and interconnecting the cuts of said second pair, said eighth foldlines providing the connection between the second panel and a pair of flaps disposed within the opening, said flaps being separated by a single cut disposed transversely of the second pair of cuts, said flaps being adapted to be folded relative to the second panel and define sides of the article-accommodating pocket when said blank is set up to form the carrier.

* * * * *